US007109449B2

(12) United States Patent
Kawase

(10) Patent No.: US 7,109,449 B2
(45) Date of Patent: Sep. 19, 2006

(54) HEATING APPARATUS CAPABLE OF CONTROLLING MAGNETIC FIELD STRENGTH BASED ON TEMPERATURE DISTRIBUTION DATA OF ROTATIONAL MEMBER IN TERMS OF CIRCUMFERENTIAL DIRECTION

(75) Inventor: Michio Kawase, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 462 days.

(21) Appl. No.: 10/105,274

(22) Filed: Mar. 26, 2002

(65) Prior Publication Data

US 2002/0158063 A1 Oct. 31, 2002

(30) Foreign Application Priority Data

Mar. 26, 2001 (JP) ..... 2001-087072

(51) Int. Cl.
*H05B 6/06* (2006.01)
*H05B 6/14* (2006.01)
*G03G 15/20* (2006.01)

(52) U.S. Cl. ..... 219/619; 219/667; 399/328

(58) Field of Classification Search ..... 219/619, 219/667, 216, 469, 470, 471; 399/328, 330, 399/331, 335, 336, 329, 69, 70
See application file for complete search history.

(56) References Cited

U.S. PATENT DOCUMENTS

| | | | | | |
|---|---|---|---|---|---|
| 4,675,487 | A | * | 6/1987 | Verkasalo | 219/619 |
| 5,512,975 | A | * | 4/1996 | Kitsu et al. | 355/200 |
| 5,752,150 | A | * | 5/1998 | Kato et al. | 399/330 |
| 5,822,670 | A | * | 10/1998 | Morigami | 399/335 |
| 6,021,303 | A | * | 2/2000 | Terada et al. | 399/328 |
| 6,297,476 | B1 | * | 10/2001 | Kashino et al. | 219/216 |
| 6,438,335 | B1 | * | 8/2002 | Kinouchi et al. | 399/328 |

FOREIGN PATENT DOCUMENTS

| | | | | |
|---|---|---|---|---|
| JP | 1-221778 | * | 9/1989 | 399/329 |

OTHER PUBLICATIONS

English translation of JP Laid–Open Patent Application No. Hei 9–134092, laid open on May 20, 1997.

* cited by examiner

*Primary Examiner*—Philip H. Leung
(74) *Attorney, Agent, or Firm*—Fitzpatrick, Cella, Harper & Scinto

(57) ABSTRACT

A heating apparatus includes a magnetic field generator that generates an alternating magnetic field, a rotatable member disposed in the alternating magnetic field and capable of generating heat by electromagnetic induction, a temperature detector that detects a temperature of the rotatable member, a comparator that compares the detected temperature to a target temperature: and a controller that controls electric energy supply to the magnetic field generator based on detected temperatures of different positions of the rotatable member.

6 Claims, 10 Drawing Sheets

HEATING APPARATUS CAPABLE OF CONTROLLING MAGNETIC FIELD STRENGTH BASED ON TEMPERATURE DISTRIBUTION DATA OF ROTATIONAL MEMBER IN TERMS OF CIRCUMFERENTIAL DIRECTION

FIELD OF THE INVENTION AND RELATED ART

The present invention relates to a heating apparatus used as a preferable fixing apparatus for an image forming apparatus, such as a copying machine, a printer, or the like, which employs an electrophotographic or electrostatic image forming method.

In recent years, the importance of energy consumption has increased due to the environmental concerns. Accordingly, a greater amount of time and effort has begun to be spent to reduce the power consumption of an image forming apparatus during an image forming operation, as well as during a standby period. Thus, it has become imperative to re-examine the structure of an image forming apparatus having a heat source, based on prior arts, which consumes a relatively large amount of electrical power.

In addition, for the sake of user convenience, it is desired to reduce warm-up time, recovery time, and first copy time (FCT). Warmup time is the time required for an image forming apparatus to become ready for image formation, being in the standby state, after the apparatus is turned on. Recovery time is the time it takes for an image forming apparatus in the standby state, in which the apparatus consumes a smaller amount of electrical power, to become ready for image formation. First copy time, or first print time (FPT) is the time it takes for the first copy in a given image forming operation to come out of an image forming apparatus after the reception of an image formation signal by the apparatus.

Further, the usage of a business machine such as an image forming apparatus has spread into a greater number of social classes; a business machine such as an image forming apparatus has begun to be used in environments unfriendly to such an apparatus, such as a construction site, or the like, as well as in an ordinary office. In other words, the environments in which an image forming apparatus is used have increased in severity.

Further, an image forming apparatus has diversified in terms of the recording medium on which a user can record an image. In other words, not only is it possible to record on ordinary paper, but also on thick paper for a postcard or a hard cover, OHT sheet, or the like.

Further, there have been changes in the originals handled by a user. For example, the number of opportunities in which color originals are used has increased, as well as the number of opportunities in which such images as the graphical images used for business presentation containing white letters surrounded by areas, the density of which is as high as that of a solid image. Thus, for satisfactory fixation, a fixing apparatus is required to satisfactorily operate under various conditions far more severe than the conditions under which it once was operated.

Further, in order to increase productivity per minute, an image forming apparatus is expected to be improved in operational speed every year. In order to increase the operational speed of an image forming apparatus, a fixing apparatus must be increased in operational speed, which results in increase in the amount of electrical power consumption.

For example, the electrical power consumption increases in the recording medium conveying portion, original feeder driving portion, original reading portion, image processing portion, image formation processing portion, and the like. Under this condition, it has become far more difficult to allocate a large amount of electrical power for an image fixation process.

In an electrophotographic image forming apparatus, a toner image, or a visible image, is formed on a piece of recording medium, with the use of toner as developer, and the recording medium on which a toner image has been formed is conveyed to a fixing apparatus, or a heating apparatus, comprising a fixing roller 100 and a pressure roller 102, which are disposed so that their peripheral surfaces press upon each other, as shown in FIG. 11. The fixing roller 100 contains, for example, a heater H1, as a heat source, and a halogen heater, and the like, as shown in FIGS. 12 and 13. After being conveyed to the fixing apparatus, the recording medium is introduced between the fixing roller 100 and pressure roller 102, and conveyed between the two rollers, being pressed upon the heating portion of the fixing roller 100 by the pressing roller 102. As the recording medium is passed between the two rollers, the toner image on the recording medium is thermally fixed to the recording medium.

In a fixing apparatus such as the above described one, the heat source of which is a halogen heater or the like, a toner image on the recording medium is fixed to the recording medium. Therefore, the surface temperature of the fixing roller 100 in the compression nip between the fixing roller 100 and pressure roller 102 needs to be no less than the melting point of toner, and also to be accurately controlled so that it remains within a range in which the recording medium is not adversely affected. For this reason, a temperature control method using an ON/OFF control circuit such as the one shown in FIG. 13 has been used thus far.

At this time, the temperature control circuit shown in FIG. 13, and its operation will be described.

As AC voltage is applied between the input terminals of the temperature control circuit shown in FIG. 13. AC voltage is applied to an SSR (solid state relay), through the heater H1, readying the fixing apparatus, and the temperature control circuit begins to control the heater H1. More specifically, it begins to obtain the surface temperature of the fixing roller 100 from a temperature detection element TH1 such as a thermistor for measuring the surface temperature of the fixing roller 100, and compare the obtained temperature with a target value for the surface temperature of the fixing roller 100. Then, it supplies electrical power to the heater H1, such as a halogen heater or the like, for a length of time proportional to the difference between the values of the detected temperature and target surface temperature.

As the surface temperature of the fixing roller 100 approaches the target value, the temperature control circuit obtains the difference between the values of the surface temperature of the fixing roller 100 detected by the temperature detection element TH1, and the target temperature, and stabilizes the temperature of the fixing roller 100 by turning on or off the SSR at a ratio proportional to the difference. In a fixing apparatus structured as described above, in which the fixing roller is heated by the radiant heat from a heat source such as a halogen heater or the like, electrical current must be supplied to the heater with predetermined intervals. Therefore, the surface temperature of the fixing roller fluctuates with a certain range, which is one of the flaws of this type of fixing apparatus. Since the SSR is repeatedly turned on and off with predetermined intervals, an excessive amount of rush current flows when the SSR is turned on to be kept on for a predetermined length of time after it is turned off. This is likely to trigger the power source flickering, which is one of the recent social problems.

A halogen heater is disposed at the center of the hollow of the metallic core of a fixing roller, holding a substantial distance from the internal wall of the metallic core. It has a large thermal resistance as does the rubber layer pasted on the peripheral surface of the fixing roller. Further, the thermal capacity of the metallic core, or a metallic roller, of the fixing roller is relatively large. Thus, the temperature of the fixing roller must be controlled by detecting the surface temperature of the fixing roller, that is, a system which is relatively large in the time constant in thermal conductivity, and also in the amount of heat reserve.

Technically, it is rather difficult to inexpensively reduce the temperature ripple of the fixing apparatus by adjusting the parameters for turning on or off the halogen heater, by detecting the material and size of a recording medium, the ambient temperature, the voltage fluctuation of the electrical power source, and the like, during the standby period, as well as the image formation period, in spite of the complexity in the thermal model.

Thus, in recent years, new methods for heating a roller have been proposed. According to one of them, a magnetic field generating means comprising a core, the cross section of which is in the form of a letter C, I, or J, and which is formed of material such as ferrite high in permeability, and a coil wound around the core, is placed in the hollow of the fixing roller. In operation, a high frequency magnetic field is generated by flowing high frequency current through the coil, and the high frequency magnetic field is guided to the internal surface of the fixing roller, generating heat within the fixing roller itself. In other words, a heating method based on electromagnetic induction is used to continuously control the amount of the heat generated by the fixing roller.

A heating method based on electromagnetic induction makes it possible to concentrate heat generation to the nip between the fixing roller and pressure roller, and its adjacencies. Thus, it is superior in that it can reduce power consumption, and the time it takes for the fixing apparatus to become ready.

In a heating method based on electromagnetic induction, the magnetic flux is focused on the predetermined range of a fixing roller by the magnetic field generating means for generating a high frequency magnetic field. Therefore, the portion of the fixing roller directly exposed to the high frequency magnetic field is mainly heated. Therefore, the temperature distribution of the fixing roller in terms of the circumferential direction is likely to become uneven.

For example, when the fixing roller is kept stationary during the standby period, it is likely that the temperature of the fixing roller becomes highest across the areas in the immediate adjacencies of the magnetic field generating means, and gradually reduces as the distance from the coil increases. Thus, as the electric power supplied to the fixing roller is increased at the start of an image forming operation, the fixing roller temperature rises, with the temperature ripple in term of the circumferential direction remaining.

Therefore, it was likely that images were unsatisfactorily fixed. More specifically, an unfixed toner image on a recording medium is thermally fixed to the recording medium by the fixing roller, which is uneven in the temperature distribution in terms of the circumferential direction. Therefore, the unfixed toner image on the recording medium is likely to be inadequately fixed, in particular, during the period from when the fixing roller begins to rotate as the image formation start key is depressed, until a certain number of copies have been produced.

SUMMARY OF THE INVENTION

The primary object of the present invention is to provide a heating apparatus which is smaller in temperature ripple.

According to an aspect of the present invention, there is provided a heating apparatus, comprising magnetic field generating means for generating an alternating magnetic field; a rotatable member disposed in the alternating magnetic field and capable of generating heat by electromagnetic induction; temperature detecting means for detecting a temperature of of said rotatable member; and control means for controlling electric energy supply to set magnetic field generating means of the basis of the temperatures detected by said temperature detecting means at positions, which are different in a rotational direction, of said rotatable member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

(Embodiment 1)

First, the first embodiment of the present invention will be described.

Figure 1:
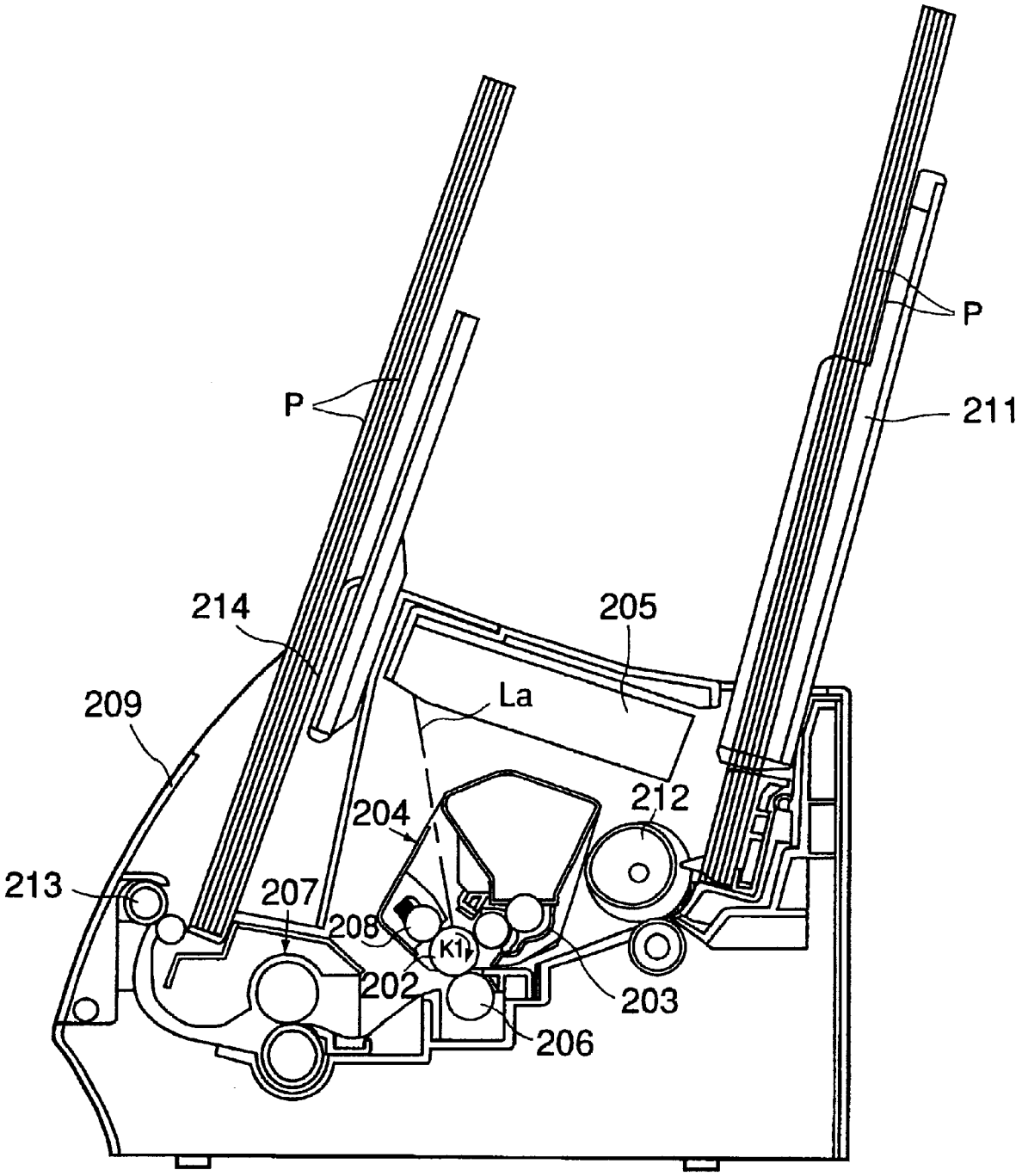
FIG. 1 is a sectional view of the image forming apparatus in the first embodiment of the present invention, for showing the structure thereof.

FIG. 1 is a schematic sectional view of an electrophotographic laser beam printer 201 (which hereinafter will be referred to as printer 201), as an example of an image forming apparatus employing a fixing apparatus in accordance with the present invention, and shows the general structure thereof.

The printer 201 is such an image forming apparatus that carries out a sequence of image formation processes, in which an image in accordance with the image formation data provided from an image formation data providing apparatus (unshown) such as a host computer or the like located outside the main assembly of the printer 201, is formed on a sheet of recording medium P, with the use of a known electrophotographic method.

Referring to FIG. 1, the printer 201 comprises: a process cartridge 204 which holds a photoconductive member 202, as a latent image bearing member, in the form of a rotational drum, and a developing apparatus 203; a laser scanner unit 205 (which hereinafter will be referred to as scanner 205) for forming an electrostatic latent image in accordance with the image formation data from the image formation data providing apparatus, on the peripheral surface of the photoconductive member 202 through an exposing process in which the peripheral surface of the photoconductive member 202 is exposed to an oscillating beam of light modulated with the image formation data; a rotational transfer member 206 in the form of a roll, for transferring the image on the peripheral surface of the photoconductive member 202 onto the recording medium P; and a fixing apparatus 207, as a heating apparatus, for fixing the toner image on the recording medium P to the recording medium P with the application of heat and pressure, after the toner image transfer.

The process cartridge 204 mounted in the printer 201 has a charge roller 208, in addition to the photoconductive member 202 and developing apparatus 203. The charge roller 208 is for uniformly charging the peripheral surface of the photoconductive member 202 to a predetermined polarity and potential level, before the peripheral surface of the photoconductive member 202 is exposed by the scanner 205. The process cartridge 204 is removably supported by the main assembly of the printer 201 to reduce the time required for maintenance, and to simplify the maintenance. In other words, when it is necessary to carry out maintenance operations such as repairing the photoconductive member 202 or replenishing the developing apparatus 203 with a fresh supply of developer, the process cartridge 204 in need of maintenance is replaced with a brand-new process cartridge, or a process cartridge, which has been repaired and/or replenished with developer, by opening a cover 209 pivotally supported by the printer main assembly.

Next, the aforementioned sequence of image formation processes carried out in the printer 201 will be described.

First, a user is to press a start button (unshown) or the like provided on the printer main assembly to give the printer 201 a signal for initiating the sequence of the image formation processes. As the start button is pressed, the photoconductive member 202 begins to be rotationally driven in the direction indicated by an arrow mark K1 at a predetermined peripheral velocity. As the photoconductive member 202 is rotationally driven, the peripheral surface of the charge roller 208 to which a predetermined bias is being applied, and the peripheral surface of the photoconductive member 202, rub against each other, causing the peripheral surface of the photoconductive member 202 to be uniformly charged to predetermined polarity and potential level.

Next, the charged portion of the peripheral surface of photoconductive member 202 is scanned by the scanner 205; it is exposed to the scanning light emitted, while being modulated with the image formation data from the image formation data providing apparatus, from the scanner 205. As a result, an electrostatic latent image in accordance with the image formation data is formed on the charged portion of the peripheral surface of the photoconductive member 202. This latent image is developed into a visible image by the developer in the developing apparatus 203. Meanwhile a recording medium P is fed into the image forming apparatus main assembly from a cassette 211, and delivered by the rotational feeding rollers 212 and the like to the space formed between the photoconductive member 202 and a transfer member 206, with a predetermined timing. The visible image on the peripheral surface of the photoconductive member 202 is transferred onto the recording medium P by the transfer member 206 as the recording medium P is conveyed between the photoconductive member 202 and transfer member 206. The cassette 211 is enabled to hold a predetermined number of recording mediums P and is removably supported in the main assembly of the printer 201.

After the image transfer, the unfixed visible image on the recording medium P is fixed to the recording medium P by a fixing apparatus 207. Then, the recording medium P is discharged from a discharge roller 213 into a delivery tray 214, and is laid upon the previously discharged recording mediums P. This concludes the aforementioned sequence of image formation processes. The discharge roller 213 is rotationally supported by the main assembly of the printer 201. The tray 214 is attached to one side of the main assembly of the printer 201.

At this time, the fixing apparatus 207, as a heating apparatus, in this embodiment will be described in detail.

Figure 2:
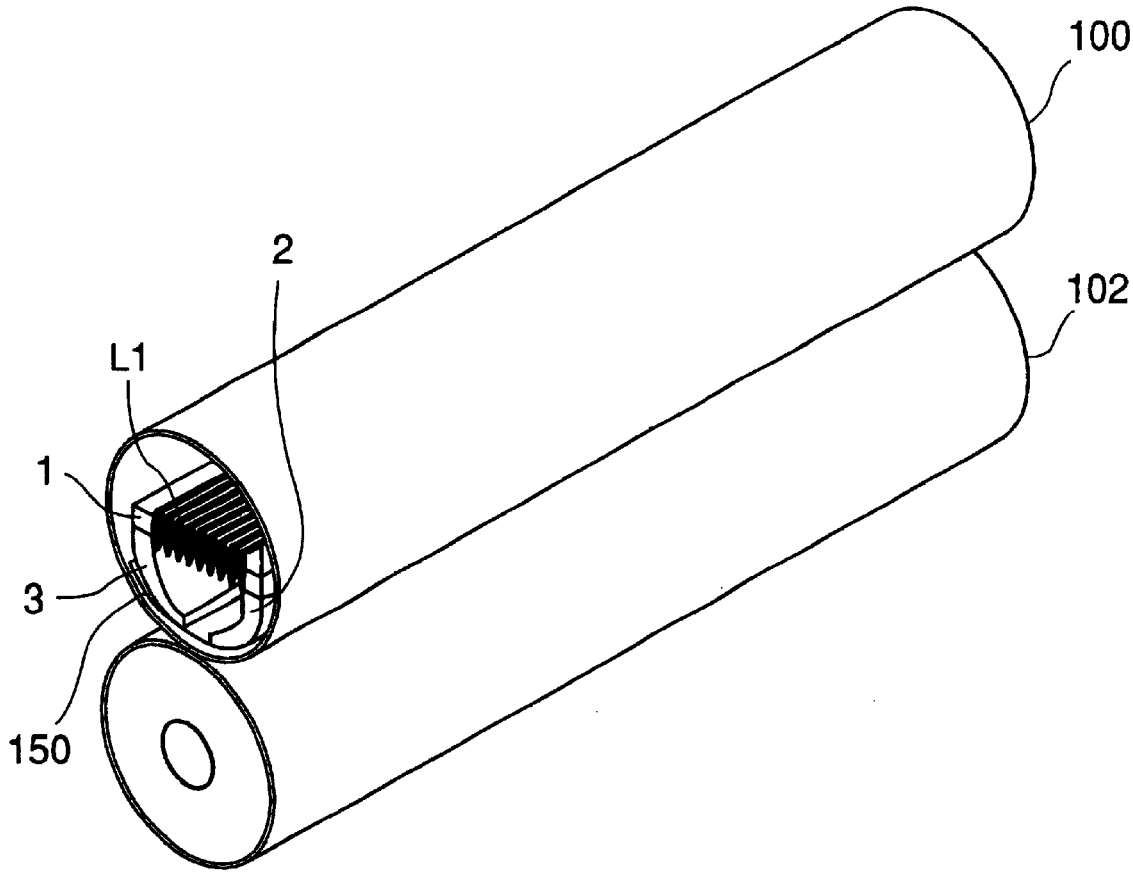
FIG. 2 is a perspective view of the heating apparatus with which the image forming apparatus is equipped, for showing the structure thereof.

FIG. 2 is a schematic perspective view of the fixing apparatus 207, and shows the general structure thereof.

As shown in FIG. 2, the fixing apparatus 207 comprises: a fixing roller 100, that is, a heat generating magnetic metallic member, for fixing the toner particles on the recording medium P to the recording medium by melting the toner particles; an inductive heating coil L1 as a magnetic flux generating means; and a magnetic field blocking member 150.

Figure 3:
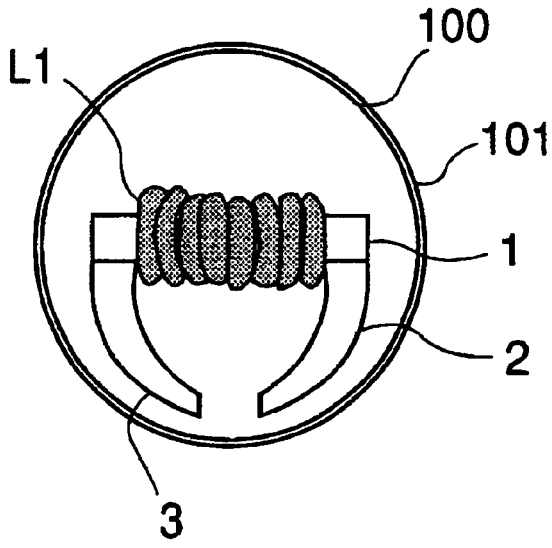
FIG. 3 is a sectional view of the heat generating portion of the heating apparatus in the first embodiment of the present invention, for showing the general structure thereof.

FIG. 3 is a sectional view of the fixing roller of the fixing apparatus in accordance with the present invention, and the adjacencies thereof, and shows the general structure thereof.

Referring to FIG. 3, the fixing roller 100 has a surface layer 101, which is a coated layer of resinous material, a plated layer of metallic material, or the like. The fixing roller 100 may be replaced with a cylindrical magnetic film.

Figure 4:
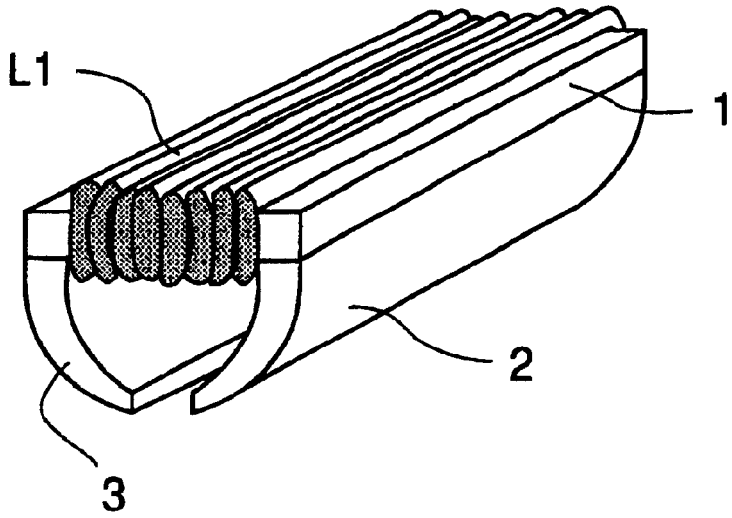
FIG. 4 is a perspective view of the magnetic flux generating means disposed within the heat generating portion in FIG. 3, for showing the general structure thereof.

Referring to FIG. 4, the inductive heating coil L1 generates a high frequency magnetic field as high frequency current is applied thereto. In order to organically focus the high frequency magnetic field generated by the inductive heating coil L1, to the internal surface of the fixing roller 100, cores 1, 2, and 3 formed of material such as ferrite are disposed in a manner to form a magnetic circuit.

Incidentally, FIG. 4 is a perspective view of the magnetic circuit components, that is, the inductive heating coil L1 and the cores 1, 2, and 3, having been removed from the fixing roller 100.

In this embodiment, the cores 1, 2, and 3 are independent from each other. The core 1 is in the form of a piece of flat plate, making it possible to insert the core 1 into the inductive heating coil L1 shaped by being wound around a bobbin, or the like, slightly larger than the core 1, so that the space on inward side of the wound coil L1 conforms in cross section to the core 1. This eliminates the need for a sophisticated wire winding technology. As for the cores 2 and 3, they are identical in shape and size, and are symmetrically disposed. The combination of the cores 1, 2, and 3 may be replaced with a T-shaped core, which makes it possible to efficiently focus the magnetic flux necessary for heating, to the portion to be heated, after the retraction of the magnetic field blocking member 150 from the portion to be heated.

Figure 6:
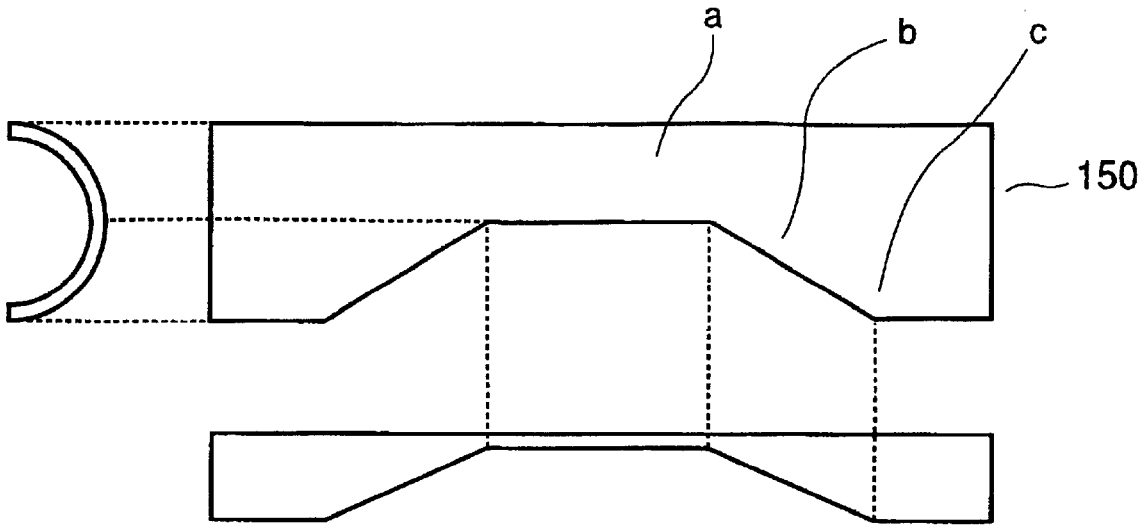
FIG. 6 is a drawing for showing an example of the magnetic field blocking member with which the heating apparatus in FIG. 2 is equipped.

FIG. 6 shows an example of the shape of the magnetic field blocking member 150.

Figure 7:
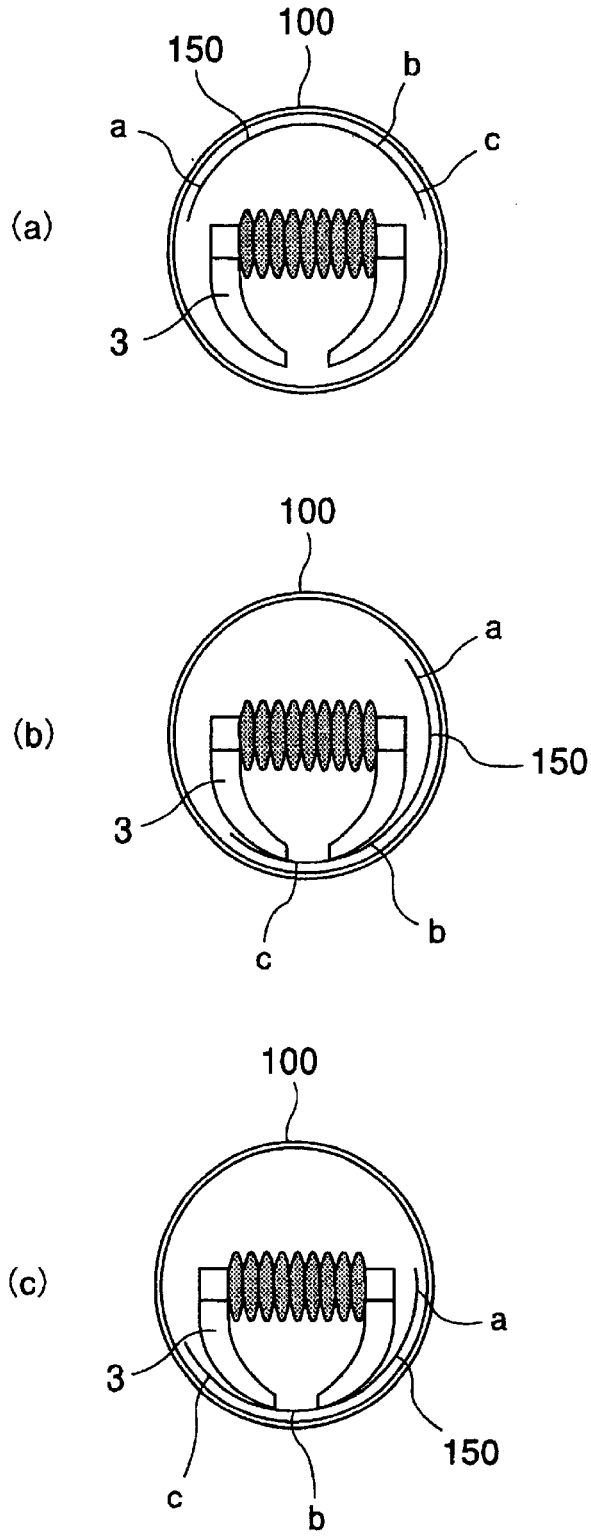
FIG. 7 is a drawing for showing the position and function of the magnetic field blocking member in the first embodiment of the present invention.

FIG. 7 shows the three positions, in the moving range of the magnetic field blocking member 150, pertinent to the description of the heating apparatus.

When the magnetic field blocking member 150 is in the position shown in Referring to FIG. 7(*a*), the magnetic flux from the inductive heating coil L1 heats the fixing roller 100 by being focused to the nip in which the fixing roller 100 and pressure roller 102 press upon each other, and the adjacencies thereof.

Figure 5:
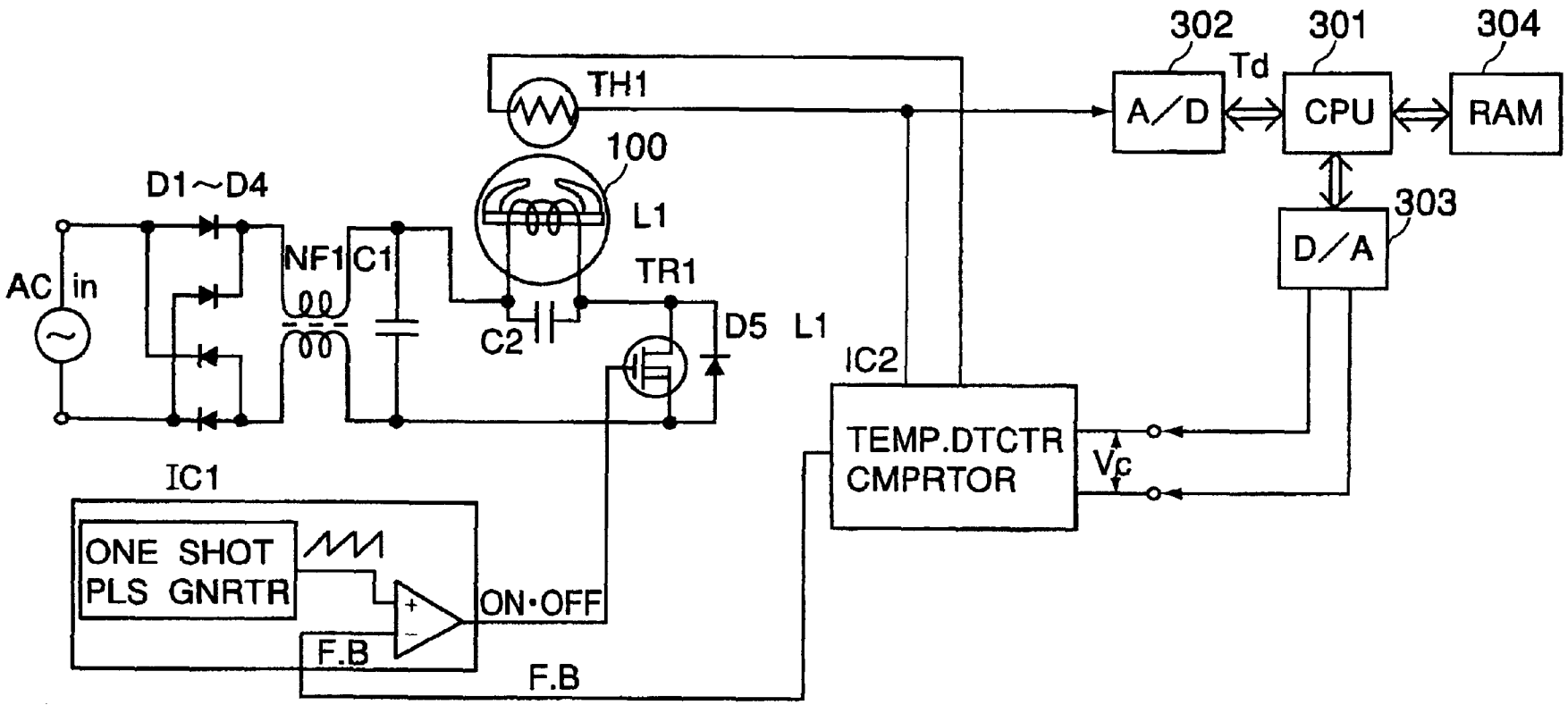
FIG. 5 is a block diagram for showing the structure of the control system of the magnetic flux generating means of the heating apparatus in the first embodiment of the present invention.

FIG. 5 is a block diagram of the electric power source circuit for driving the inductive heating coil L1 of the fixing apparatus in accordance with the present invention, and shows the structure thereof.

The inductive heating coil driving power source circuit comprises: a power switching element TR1, which is a MOS-FET, the inductive heating coil L1, which is the load of the circuit; and a flywheel diode D5 for regenerating the electrical power accumulated in the inductive heating coil L1. The temperature detection element TH1 as a temperature detecting means is thermally connected to the fixing roller 100 through the structural arrangement shown in FIG. 5, and its output is inputted into the temperature comparison circuit IC2.

The temperature comparison circuit IC2 compares a temperature adjustment input signal with the output of the temperature detection element TH1, and the difference is inputted as a control signal into a pulse modulation oscillation circuit IC1 (which hereinafter will be referred to as PFM oscillation circuit). The PFM oscillation circuit IC1 generates PFM pulses proportional to the value of the control signal, and outputs to the gate of the electrical power switching element TR1, driving the electrical power switching element TR1. The aforementioned inductive heating coil driving power source circuit in this embodiment is supplied with pulsating current generated by rectifying AC power with the use of rectifying elements D1–D4 which are diodes for rectifying the AC power input.

A transformer NF1 and a condenser C1 constitute a noise filter, and the constant therefor is set to ensure that the switching noises generated by the electric power switching element TR1 are sufficiently damped, whereas the high frequency electric power is allowed to pass without being damped.

Next, the operation of the inductive heating coil driving power source circuit will be described.

As input AC voltage is applied between the input terminals shown in FIG. 5, it is rectified into pulsating current, by the rectifying elements D1–D4. The voltage of this pulsating current is applied to the terminals of the condenser C1 through the transformer NF1. At this stage, the waveform of the voltage between the terminals of the condenser C1, reflects the waveform resulting from the rectification of the input AC voltage.

As a temperature adjustment input signal Vc is inputted into the temperature comparison circuit IC2, the temperature comparison IC2 compares the output of the temperature detection element TH1 with the value of the target temperature. Then, the output of the temperature comparison circuit IC2 is applied, as a control signal, to the PFM oscillation circuit IC1.

The PFM oscillation circuit IC1 generates a PFM signal proportional in pulse to the value of the control signal. Its output is applied between the gate sources of the electrical power switching element TR1, which turns on or off in response to the output pulse of the PFM oscillation circuit IC1, allowing drain current ID to flow: in other words, current is allowed to flow through the inductive heating coil L1.

The inductive heating coil L1 stores the current allowed to flow as the electric power switching element TR1 is turned on. Therefore, when the electric power switching element TR1 is turned off, the inductive heating coil L1 generates reverse voltage, causing forward current to flow through the flywheel diode D5, and storing thereby the current in a high frequency resonance condenser C2. Then, as the electric power switching element TR1 is turned on again, current flows through the inductive heating coil L1, and the current is stored in the inductive heating coil L1. This sequence is repeated. As a result, high frequency resonance current flows between the inductive heating coil L1, which constitutes the load, and the high frequency resonance condenser C2.

The current which flows through the electric power switching element TR1 and inductive heating coil L1 is smoothed as the high frequency resonance condenser C2 stores and discharges the high frequency component of the current. As a result, high frequency current does not flow through the transformer NF1; only rectified AC current flows through the transfer former NF1.

The current which flows through the rectifying diodes D1–D4 acquires the waveform that is effected as the waveform of the current which flows the electric power switching element TR1 and inductive heating coil L1 is filtered by the noise filter constituted of the condenser C1 and transformer NF1. Therefore, the waveform of the input AC current prior to rectification turns into a waveform which closely resembles the waveform of the input AC voltage, substantially reducing the high frequency component in the input current. Therefore, the power factor of the input current of the aforementioned driving power source circuit as a temperature adjustment circuit is substantially improved.

The transformer NF1 and condenser C1, which are used as noise filters in this driving power source circuit have only to be capable of filtering the high frequency components of the PFM signal generated by the PFM oscillation circuit IC1. Therefore, the capacity of the condenser C1 and the inductance of the transformer NF1 can be reduced, which in turn makes it possible to reduce them in size and weight.

As a temperature adjustment signal is inputted into the driving power source circuit for the inductive heating coil L1, high frequency AC power, the frequency of which is in a range of 20 KHz–100 KHz, is generated between the output terminals of the power source for the inductive heating coil L1.

This AC power is applied to the inductive heating coil L1, and the inductive heating coil L1 generates AC magnetic field. The AC power applied to the inductive heating coil L1 at this stage fluctuates depending on the object to be heated, normally within a range of two to three hundred watts to several thousand watts.

The AC magnetic field generated by the AC power applied to the inductive heating coil L1 applies the high frequency magnetic field to the fixing roller 100 by way of ferrite cores 1, 2, and 3, through the space between the cores 2 and 3. As a result, high frequency magnetic flux penetrates fixing roller 100, inducing eddy current within the fixing roller 100. This eddy current generates Joule heat within the fixing roller 100, heating the fixing roller 100. In other words, this electromagnetic induction causes the fixing roller 100 to generate heat. As a result, the surface temperature of the fixing roller 100 increases.

The output of the temperature detection element TH1 for measuring the surface temperature of the fixing roller 100 is continuously inputted into the temperature comparison circuit IC2, by which it is compared with the target temperature Vc. The difference between the temperature detected by the temperature detection element TH1 and the target temperature Vc is inputted as a feed back signal FB into the PFM oscillation circuit IC1.

The temperature comparison circuit IC2 keeps constant the surface temperature of the fixing roller 100 by generating such feedback signals FB that when the temperature detected by the temperature detection element TH1 is no more than the target temperature Vc, the temperature comparison circuit IC2 increases the high frequency power applied to the inductive heating coil L1, whereas as the temperature detected by the temperature detection element TH1 exceeds the target temperature, the temperature comparison circuit IC2 decreases the high frequency power applied to the inductive heating coil L1.

Into the PFM oscillation circuit IC1, the difference detected by the temperature comparison circuit IC1 between the temperature detected by the temperature detection element TH1 and the target temperature is inputted. Then, the length of the time the gate of the electric power switching element TR1 is kept on is determined in response to the difference. In other words, the amount of electrical power passed through the electrical power switching element TR1 is adjusted to control the amount of the electrical power inputted into the inductive heating coil L1. As a result, the amount of the heat generated by the fixing roller 100 is controlled to stabilize the toner fixation temperature.

As for the temperature control while the apparatus is on standby, the target temperature Tst for a standby period is sent from a CPU 301 as a controlling means to a digital-analog converter 303 (which hereinafter will be referred to as D/A converter). The output of the D/A converter 303 is inputted, as a temperature adjustment input signal Vc (=Tst), to the temperature comparison circuit IC2, in which the output of the D/A converter 303 is compared with the output of the temperature detection element TH1. When the difference is zero, it is determined that the standby period target temperature Tst has been reached. Then, a feedback signal FB (=0) is sent to the PFM oscillation circuit IC1, and a predetermined amount Wst of electrical power is applied to the inductive heating coil L1.

In this embodiment, the amount of electrical power applied to the inductive heating coil L1 is controlled for each rotation of the fixing roller 100, in response to the temperature detected by the temperature detection element TH1. The output of the temperature detection element TH1 is inputted into an A/D converter 302, and the information regarding the current temperature of the fixing roller 100 is sent to the CPU 302. As the CPU 301 detects that the temperature of the fixing roller 100 has reached the standby period target temperature Tst, the image forming apparatus becomes ready for an image forming operation. Then, as an image formation start signal is received, the image forming apparatus begins an image forming operation.

At this time, the temperature distribution of the fixing roller will be described.

Conventionally, if the amount of the heat robbed from the fixing roller by recording medium is large, the fixing roller temperature rapidly decreased each time recording medium passes by the fixing roller. Further, what is unignorable is the amount of the heat which radiates from the heating portion of the fixing roller, near the inductive heating coil, into the fixing apparatus itself or the adjacencies of the fixing apparatus, when the main assembly of an image forming apparatus or the main assembly of a fixing apparatus is cold. In other words, the heat radiation is one of the essential causes of the rapid temperature decrease immediately after the starting of an image forming apparatus, being therefore one of the causes of fixation failure.

In the past, such an image forming apparatus has been proposed that when on standby, the power for fixation is turned off, keeping therefore the fixing roller stationary, and supplying the fixing apparatus with no power, in order to reduce the standby period power consumption.

Such an image forming apparatus suffered from fixation failure, when an image forming apparatus and the fixing apparatus thereof were cold when an image forming operation began. This is for the following reason. That is, if the image forming apparatus and the fixing apparatus thereof is cold, the amount of the heat lost from the fixing roller to the fixing apparatus itself, the sections of the image forming apparatus other than the fixing apparatus, and the like, is substantial. Thus, if the fixing roller begins to generate heat after image formation signal reception, the fixing roller fails to compensate for the aforementioned heat loss. Therefore, as image formation continues, the temperature of the fixing roller gradually decreases to a point at which fixation failure occurs, in particular, when forming an image high in toner density on recording medium such as cardboard, which is large in thermal capacity.

Thus, it is feasible to keep the surface temperature of a fixing roller at a temperature lower than the image formation temperature.

It is also feasible to keep a fixing roller stationary when on standby, while heating the fixing roller so that the surface temperature of the fixing roller remains at a predetermined level.

In such a case, that is, when a fixing roller is kept stationary during a standby period, the surface temperature of the fixing roller becomes nonuniform in terms of its circumferential direction, being highest across the area near the inductive heating coil, for the following reason. That is, after an image forming apparatus is turned on, the internal temperature of the image forming apparatus and the main assembly of the fixing apparatus remains low for a while, in particular, when the image forming apparatus has been left in a low temperature environment. Thus, even after the fixing roller begins to generate heat across the area near the inductive heating coil, the temperature of the portion of the fixing roller which was apart from the inductive heating coil when the fixing roller was kept stationary remains lower than the temperature of the portion of the fixing roller which was near the inductive heating coil when the fixing roller was kept stationary, for a while. In other words, a substantial amount of temperature disparity remains across the fixing roller in terms of the circumferential direction.

Thus, assuming that when an image forming apparatus is kept on standby, the fixing roller is kept stationary, it is possible to set the standby target temperature for the portion of the fixing roller near the inductive heating coil high enough for the temperature of the portion of the fixing roller apart from the inductive heating coil to be kept reasonably high by the thermal conduction of the fixing roller in its circumferential direction, in consideration of the fact that heat is robbed from the fixing roller by recording medium or the like. In this case, the standby target temperature for the portion of the fixing roller closer to the inductive heating coil is set to a level lower than that for image formation, substantially reducing the amount of the power consumed during the standby period compared to that used during image formation.

This method can prevent the fixation failure traceable to the drop in the fixing roller temperature resulting from a continuous image forming operation of a substantial length. In this method, however, when the fixing roller is stationary, the portion of the fixing roller closer to the inductive heating coil in terms of the circumferential direction becomes substantially higher in temperature than the other portion of the fixing roller, causing the high temperature offset for each rotation of the fixing roller.

Thus, in order to prevent fixation failure even during a long continuous image forming operation while preventing the high temperature offset immediately after the starting of the image forming operation, the above described fixing roller temperature for a standby period should be set to a value within a range in which the high temperature offset does not occur.

In this embodiment, as the image-forming apparatus is turned on, the CPU 301 sets the standby target temperature Tst in the D/A converter 303, and the temperature adjustment signal Vc (=Tst) is sent to the temperature comparison circuit IC2 (it is assumed in this case that the warmup target temperature and standby target temperature are equal).

In order to detect the temperature of the fixing roller 100, the output of the temperature detection element TH1 is inputted into the temperature comparison circuit IC2.

The temperature comparison circuit IC2 compares the inputted temperature adjustment signal and the output of the temperature detection element TH1, and inputs the difference into the PFM oscillation circuit IC1, as a control signal. The PFM oscillation circuit IC1 generates PFM pulse proportional to the value of the control signal, generating high frequency power between the output terminals of the power source, and this high frequency power is applied to the inductive heating coil L1. As a result, heat is generated in the fixing roller 100 by the current electromagnetically induced in the fixing roller 100, gradually increasing the surface temperature of the fixing roller 100.

When the temperature of the fixing roller is lower than the standby target temperature Tst, the amount of the high frequency electrical power applied to the inductive heating coil L1 is increased beyond the aforementioned predetermined amount Wst, as high as an amount of W1, in response to the temperature detected by the temperature detection element TH1 and inputted temperature adjustment signal. When the temperature of the fixing roller is higher than the standby target temperature Tst, the amount of the electrical power applied to the inductive heating coil L1 is reduced below the predetermined amount Wst, as low as an amount W2.

When the temperature detected by the temperature detection element TH1 is equal to the standby target temperature Tst, the amount of the electric power supplied to the inductive heating coil L1 is the predetermined amount Wst.

Until the temperature of the fixing roller reaches the standby target temperature Tst, the image forming apparatus cannot start an image forming operation; in other words, the image forming apparatus remains in the warmup state. As the temperature T of the fixing roller 100 reaches the standby target temperature Tst, the CPU 301 detects the detected temperature T (=Tst) through the A/D converter 302, placing the image forming apparatus in the standby state. Then, as the image forming apparatus receives an image formation start signal, the CPU 301 allows the image forming apparatus to start an image forming operation, readying the apparatus for image formation.

As the CPU 301 receives an image formation start signal from a host computer (unshown), an image reading apparatus (unshown), or the like, it sends the image formation target signal Tcp to the A/D converter 302, as a temperature adjustment signal, increasing the electrical power supplied to the inductive heating coil L1, and turns on the fixing apparatus driver (unshown) to begin to rotate the fixing roller 100.

The rotation of the fixing roller 100 makes it possible for the temperature detection element TH1 to detect the temperature of the fixing roller 100 in its circumferential direction. When it is determined, based on the comparison between the temperature detected by the temperature detection element TH1 and the aforementioned inputted temperature adjustment signal, that the temperature of the fixing roller is lower than the image formation target temperature Tcp, the amount of the high frequency electrical power applied to the inductive heating coil L1 is increased beyond the aforementioned predetermined amount Wcp, as high as an amount W1. When the temperature of the fixing roller is higher than the image formation target temperature Tcp, the amount of the electrical power applied to the inductive heating coil L1 is reduced below the predetermined amount Wcp, as low as an amount W2. When the temperature detected by the temperature detection element TH1 is equal to the temperature Tcp, the electrical power applied to the inductive heating coil L1, is set to the predetermined amount Wcp. As described above, in this embodiment, the electric power applied to the inductive heating coil L1 is controlled in a manner to compensate for the uneven temperature distribution of the fixing roller 100 in terms of its circumferential direction. Therefore, the unevenness in the temperature distribution of the fixing roller 100 is reduced.

However, unless the temperature of the fixing roller is higher than the image formation target temperature across the entirety of the fixing roller surface, fixation failure occurs across the areas, the temperature of which is lower than the image formation target temperature. In other words, the minimum temperature in the temperature distribution of the fixing roller in terms of its circumferential direction is higher than a desired temperature, fixation failure does not occur. However, when the maximum temperature in the temperature distribution of the fixing roller in terms of the circumferential direction is excessively high, high temperature offset occurs.

Thus, it is possible to determine whether or not fixation will be satisfactorily done, based on whether or not the detected highest and lowest temperatures of the fixing roller in terms of the circumferential direction are within a predetermined image formation target range. However, the overall amount of the heat the fixing roller has cannot be determined solely from the detected highest and lowest temperature of the fixing roller. For example, When the fixing roller temperature gradually reduces as an image forming operation continues, certain portions of the fixing roller fall below the image formation target temperature, causing fixation failure, after the production of a certain number of copies.

Further, technically, it is rather difficult to create a simple thermal model usable for estimating and controlling the fixing roller temperature, which encompasses all the factors, for example, whether or not the apparatus is on standby, how well or poorly images are being formed, the type of recording medium, the size of recording medium, the ambient temperature, and the like.

Thus, in this embodiment, the fixing roller temperature was controlled in the following manner. First, the average temperature of the fixing roller in terms of the circumferential direction was obtained by measuring the fixing roller temperature for a single rotation of the fixing roller. Then, when the average temperature was lower than the image formation target temperature, the temperature adjustment signal was modified in the direction to increase the amount of the electric power applied to the inductive heating coil L1 so that the fixing roller temperature was increased. When the average temperature was higher than the image formation target temperature, the temperature adjustment signal was modified in the direction to reduce the amount of the electric power applied to the inductive heating coil L1 so that heat was generated in the fixing roller by an amount not enough to raise the fixing roller temperature to the image formation target temperature.

When the fixing roller 100 has a diameter of 30 mm, and the process speed PS of the fixing roller 100 is 94.2 mm, the rotational speed of the fixing roller 100 is 60 rpm. The output of the temperature detection element TH1 is digitized by the A/D converter 302, and is read as the temperature data Td of the fixing roller 100, by the CPU 301. When the fixing roller temperature is measured every 100 milliseconds, it is measured at 100 points of the fixing roller 100 per rotation.

The temperature data Td per rotation of the fixing roller 100 are consecutively stored in Addresses 00–63H in a random access memory 304 (which hereinafter will be referred to as RAM).

As the temperature data Td are obtained, the CPU 301 stores the cumulative value Ttp of the temperature data Td, in Address 64H, totaling all the values of the fixing roller temperature at 100 points. Then, it stores the total value Tsum of the temperature data Td per rotation of the fixing roller 100 (in Address 64H), in Address 65H of the RAM, and clears the cumulative value Ttp in Address 64H of the RAM 304. Then, the temperature Td of the fixing roller 100 is measured every 100 milliseconds for the following rotation of the fixing roller 100, and is cumulatively stored in Address 64H, as the cumulative value Ttp.

The average temperature value Tavd of the fixing roller temperature per rotation is obtained by dividing the total value Tsum of all the values of the fixing roller temperatures measured per rotation, at 100 points on the peripheral surface of the fixing roller in terms of the circumferential direction, by 100 or the number of the points at which the fixing roller temperature was measured. Incidentally, instead of the average temperature value Tavd, the total temperature value Tsum may be used. In such a case, the temperature data other than the total value Tsum of the fixing roller temperatures measured per rotation have only to be handled by being multiplied by 100. For example, the total value Tsum has only to be compared with the image formation target temperature Tcp×100.

The CPU 301 calculates the average temperature Tavd (=Tsum/100), and stores it in Address 66H. Then, it calculates the temperature difference ΔTav by subtracting average temperature Tavd from the image formation target temperature Tcp, and stores it in Address 67H. Next, it stores the result of adding the image formation target temperature Tcp and temperature difference δTav, in Address 68H, as a new image formation target temperature Tcp2. Then, the CPU 301 inputs the target temperature Tcp2 for image formation in the D/A converter 303, by which the target temperature Tcp2 is made analog and sent as the temperature adjustment signal Vc (=Tcp2) to the temperature comparison circuit IC2. In the temperature comparison circuit IC2, the current fixing roller temperature is compared with the new temperature adjustment signal Vc, and a feedback signal FB is sent from the temperature comparison circuit IC2 to the PFM oscillation circuit IC1 to control the electric power applied to the inductive heating coil L1.

As is evident from the above description, in this embodiment, in order to reduce the temperature ripple of the fixing roller, the electric power applied to the inductive heating coil L1 is controlled, that is, increased or decreased, by detecting the temperature of the fixing roller 100 while the fixing roller 100 is rotating during image formation, and comparing the detected temperature with the target temperature for image formation. Further, in consideration of the fact that when the temperature target for image formation is modified in accordance with the average temperature of the fixing roller 100 in terms of the circumferential direction, the amount of heat in the fixing roller 100 falls below a satisfactory level due to a substantial amount of heat rubbed from the fixing roller 100 by the recording medium and the components in the adjacencies, the temperature adjustment signal is generated by adding to the target temperature for image formation, the difference obtained by subtracting the average temperature of the fixing roller 100 from the target temperature for image formation. Therefore, not only is the temperature ripple of the fixing roller 100 reduced, but also the temperature of the fixing roller 100 does not drastically drop even during a long and continuous image forming operation.

Further, when the average temperature is higher than the target temperature for image formation, the target temperature is temporarily lowered. Therefore, the fixing roller temperature does not unexpectedly rise.

Thus, according to this embodiment, a satisfactory copy, that is, a copy which does not show signs of fixation failure or high temperature offset, can be obtained regardless of the material and size of recording medium, the ambience in which the image forming apparatus is operated, or the like factors.

Incidentally, the range in terms of the circumferential direction of the fixing roller 100 across which the fixing roller temperature is detected is desired to be no less than the full circumference of the fixing roller 100.

Next, an image forming operation for forming an image on a recording medium of a smaller size will be described.

As a user selects recording medium size by operating the control panel (unshown) of an image forming apparatus, the CPU 301 of the image forming apparatus receives sheet size data. It also receives recording medium size from a host computer (unshown). As the CPU 301 receives the medium size data, the magnetic field shield driving motor (unshown)

is activated to rotationally move the magnetic field blocking member 150 from the position shown in FIG. 7(*a*) to the position shown in FIG. 7(*b*). When an image is formed on a recording medium of the smallest width, the magnetic field blocking member 150 is moved to the position shown in FIG. 7(*c*). In other words, the magnetic field blocking member 150 is rotationally moved to an optimal position according to the size of a recording medium to be passed through the fixing apparatus. With this arrangement, a part of the magnetic flux from the inductive heating coil L1 is blocked by the magnetic field blocking member 150, narrowing the range of the magnetic field so that the lengthwise end portions of the fixing roller 100 are shielded from the magnetic field, or are exposed to a smaller amount of magnetism. As a result, the amount by which heat is generated in the lengthwise portions of the fixing roller 100 is reduced.

In other words, the temperature of the fixing roller 100 is controlled by rotating the magnetic field blocking member 150.

Since the range across which heat is generated in the fixing roller 100 is narrowed or widened with respect to the lengthwise center of the fixing roller 100 in accordance with the recording medium size, it is possible to prevent the temperature of the lengthwise end portions of the fixing roller 100 from excessively rising. However, in the case of this structural arrangement, where and how heat is generated and conducted, more specifically, the manner in which heat is generated in the lengthwise center portion of the fixing roller 100 and conducts therefrom toward the lengthwise ends of the fixing roller 100, or the manner in which heat radiates from the lengthwise ends of the fixing roller 100, when an image is formed on a recording medium of a small size is used, are different from the manner in which an image is formed on a recording medium of the standard size when the magnetic field is not partially blocked. Therefore, the temperature control carried out when a recording medium of the standard size is used, and therefore, heat is generated across virtually the entire range of the fixing roller 100, is made different from the temperature control carried out when heat is generated only across the center portion of the fixing roller 100, so that the optimal temperature control is carried out for the conditions under which an image forming operation is carried out. Therefore, not only is an image is satisfactorily fixed, but also the temperature of the lengthwise end portions of the fixing roller 100 is prevented from unnecessarily rising while a long and continuous image forming operation is carried out.

To described this temperature control in detail, in order to prevent the temperature of the lengthwise end portions of the fixing roller 100 from unnecessarily rising, the CPU 302 moves the magnetic field blocking member 150, with the use of the magnetic filed blocking member driving motor (unshown), from the position shown in FIG. 7(*a*) to the position shown in FIG. 7(*b*), according to the recording medium size data. Then, it calculates the difference δTav obtained by subtracting the average temperature Tavd from the target temperature Tcp for image formation, and multiplies the difference δTav by a correction factor α. Then, it adds δTav×α to the target temperature Tcp for image formation, and stores the result in Address 68H, as a new target temperature Tcp3 for image formation. Next, the corrected target temperature Tcp3 is inputted in the D/A converter 303 by the CPU 301, and the feedback signal FB is sent from the temperature comparison circuit IC2 to the PFM oscillation circuit IC1, to control the amount of the electric power applied to the inductive heating coil L1. A correction factor α greater than one (α>1) is effective to prevent the temperature of the center portion of the fixing roller 100 from falling when the heat generated in the center portion of the fixing roller 100 is robbed by the lengthwise end portions of the fixing roller 100 and the components in the adjacencies of the fixing roller 100. When an image is formed on a standard recording medium, or a recording medium, the dimension of which in the lengthwise direction of the fixing roller 100 is virtually the same as the length of the fixing roller 100, the correction factor should be set to one (α=1).

Further, the value of the correction factor α may be adjusted according to recording medium characteristics regarding material, size, thickness, and the like, selected by a user with the use of the control panel (unshown), or the data regarding the recording medium sent from a host computer (unshown). In other words, the value of the correction factor a may be finely adjusted for better fixation, because the manner in which an image is fixed is made to change, by various factors, for example, material type, that is, whether a recording medium is OHP sheet, thin paper, cardboard, glossy paper, or the like, or thickness of recording medium, and specific heat of recording medium.

Further, a method for varying the fixation speed according to recording medium material has been proposed. In the case of this method, the amount of heat robbed by recording medium varies depending on the speed at which recording medium is passed through a fixing apparatus. That is, the slower the rotational speed of a fixing roller, the greater the amount by which the fixing roller temperature falls as recording medium is passed through the fixation nip; in other words, the amount by which the average temperature of the fixing roller falls per rotation also increases. Therefore, the rate at which the average temperature of the fixing roller gradually falls during a continuous image forming operation increases. Thus, for a low speed fixation process, it is also effective to give the correction factor α a value greater than the value for a normal speed fixation process. However, it is desired that depending upon the material and size for recording medium, size of the range across which the magnetic field is blocked, fixation process speed, and ambient temperature, such a value is set for the correction factor a that an optimum amount of electric power is applied to the inductive heating coil.

In other words, according to this embodiment, the problems which a fixing apparatus and an image forming apparatus, which employs an inductive heating method suffer, for example, the temperature ripple, temperature drop during a continuous image forming operation, offset traceable to abnormally high temperature, or the like, can be reduced or prevented by properly controlling the fixation temperature by controlling the amount of the electric power applied to the inductive heating coil L1, based on the various factors in image formation, for example, the warmup condition, standby condition, size, thickness, and material of recording medium, recording medium conveyance speed, and the like. Also, according to this embodiment, the problems such as the formation of an unsightly image traceable to fixation failure can be prevented with the use of a simple and inexpensive structure. Therefore, an image can be satisfactorily fixed.

Further, the temperature rise at the lengthwise end portions (ranges outside recording medium path) of the fixing roller 100 is prevented by adjusting the strength of the magnetic field applied from the inductive heating coil L1 to the fixing roller 100, with the use of the magnetic field blocking member 150. Therefore, the annoying operation of exchanging the fixing roller, or the like, is eliminated. Thus, a satisfactory fixing performance is maintained even when a recording medium substantially smaller than the standard recording medium is used; the temperature of the room in which an image forming apparatus is placed is lower than the normal one; the main assembly of a fixing apparatus and/or the main assembly of an image forming apparatus, have cooled down; a recording medium formed of cardboard or the like is used; a high density toner image, such as a color image, has been transferred across the entirety of a recording medium; or the like.

(Embodiment 2)

Next, the second embodiment of the present invention will be described. The structural arrangements and components similar to those in the first embodiment will be given the same referential codes as those given to the counterparts in the first embodiment, omitting their description.

This embodiment is characterized in that the electric power applied to the inductive heating coil L1 is controlled by adjusting the feedback signal FB obtained by converting the temperature of the fixing roller 100, with the use of a lookup table (which hereinafter will be referred to as LUT), according to the size, material, and the like, of the recording medium.

Further, the analog feedback signal FB generated in proportion to the value set in the D/A converter 303 by the CPU 301, is inputted into the resonance control circuit IC1, instead of the temperature comparison circuit IC2.

Figure 8:
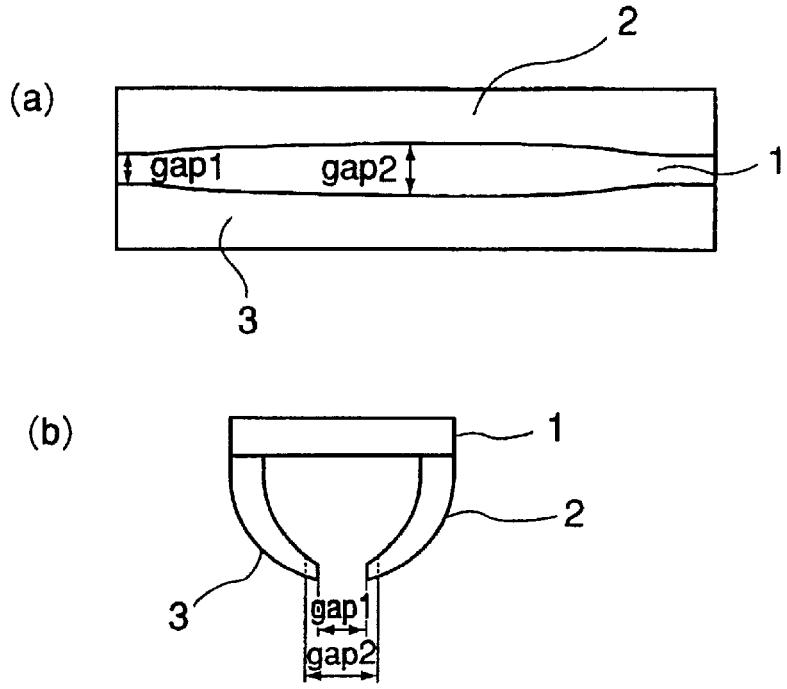
FIG. 8 is a drawing for showing the configuration of the ferrite core for the magnetic flux generating means in the second embodiment of the present invention.

Further, in this embodiment, the cores 1, 2, and 3 are configured as shown in FIG. 8, so that the density of the magnetic flux of the magnetic field applied from the inductive heating coil L1 to the fixing roller 100 is optimized.

Figure 9:
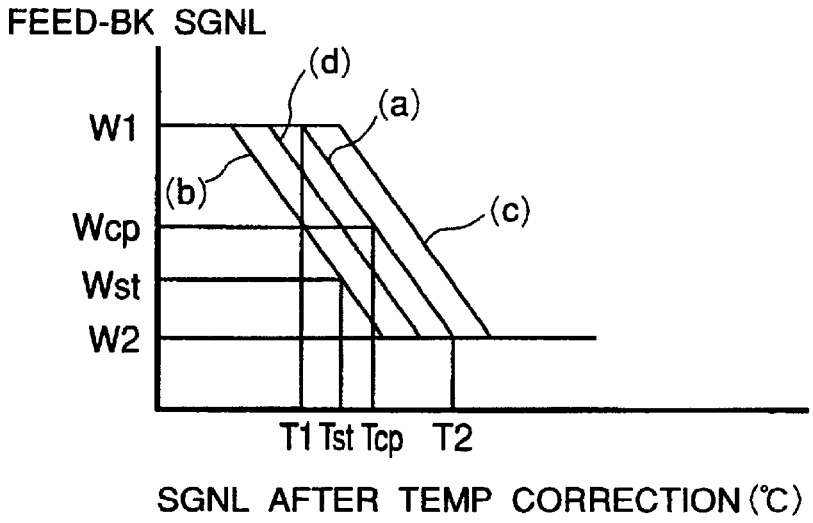
FIG. 9 is a graph for showing the relationship between the target temperature for the heating member and the electrical power supplied to the magnetic flux generating means, after the compensation made for the manner in which the magnetic flux generating means in the second embodiment of the present invention is controlled.

FIG. 9 shows the relationship between the post-correcting temperature signal Tb for achieving the target temperature for the fixing roller 100, and the amount of the electrical power applied to the inductive heating coil L1.

Figure 10:
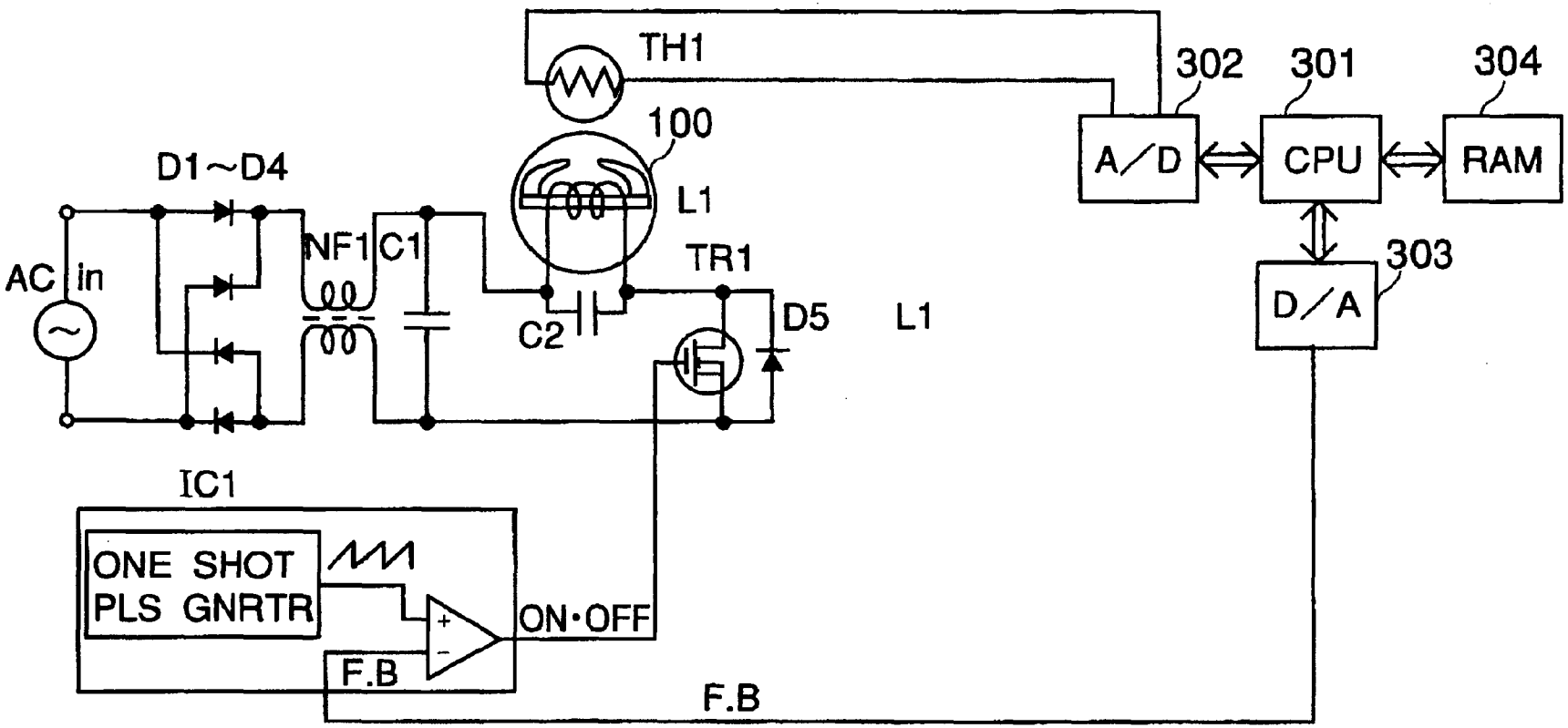
FIG. 10 is a block diagram of the control system of the magnetic flux generating means of the heating apparatus in the second embodiment of the present invention, for showing the structure thereof.
Figure 11:
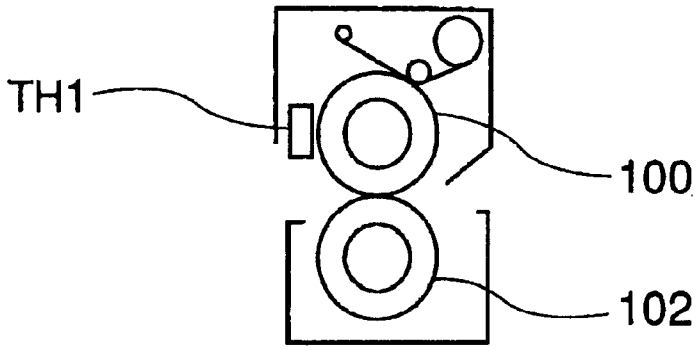
FIG. 11 is a sectional view of the heating apparatus in the first embodiment of the present invention, which employs an inductive heating method, for showing the structure thereof.
Figure 12:
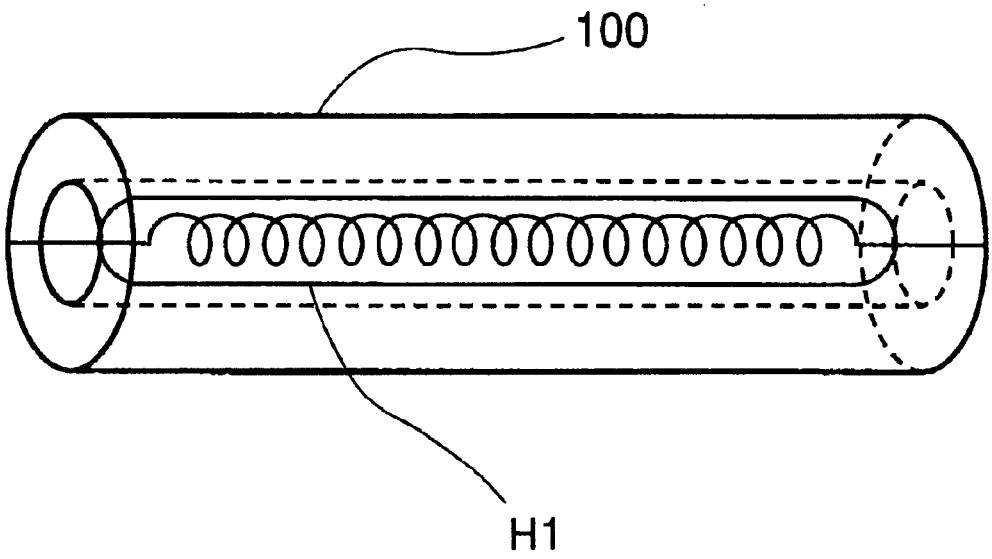
FIG. 12 is a sectional view of a heating apparatus in accordance with the prior arts, which employs a halogen heater, for showing the structure thereof.
Figure 13:
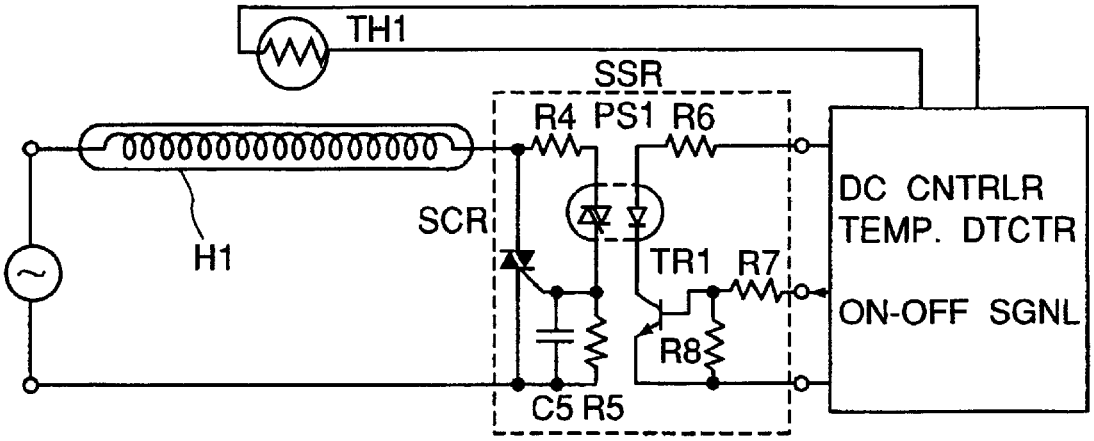
FIG. 13 is a block diagram of the control system of the magnetic flux generating means of the heating apparatus in accordance with the prior arts.

Next, referring to FIG. 10, how the average fixing roller temperature value is processed in the control circuit for driving the inductive heating coil L1 in this embodiment will be described.

The temperature Td of the fixing roller 100 is digitized by the A/D converter 302, and is read by the CPU 301. Then, the average temperature of the fixing roller is processed as will be described later. Further, the data regarding the target temperature for image formation sent from the CPU 301 are converted into analog signals by the D/A converter 303, becoming feedback signals FB, which determines the amount of the output of the electric power source for inductive heating.

The LUT represented by the solid line (a) in FIG. 9 has 512 temperature steps stored in Addresses 00H–1ffH in the RAM 304, for example. The LUT may be designed to show the relationship between the temperature T detected by the temperature detection clement TH1 and the feedback signal FB.

Provided that the unit by which the temperature detection element TH1 detects the fixing roller temperature, or the temperature unit correspondent to each of the aforementioned 512 temperature steps, is 0.5° C., the feedback signal FB is enabled to generate 512 temperature levels within a temperature range of 0° C. to 255.5° C. Obviously, the LUT may be designed to accommodate 513 or more temperature control steps and a corresponding memory region, in order to make it possible to control the fixing roller temperature in a wider temperature range.

Further, the feedback signal FB may be generated from the temperature T detected by the temperature detection element TH1 through the computation carried out based on the computation program within the CPU 301. This method has merit in that it does not require a large memory region for the LUT. For example, the relationship between the detection signal of the temperature detection element and the feed back signal FB may be computed based on the change points in FIG. 9, with the use of an approximate linear computation expression.

In this embodiment, upon reception of an image formation start signal, the CPU 301 rotates the fixing roller 100, and obtains the average temperature Tavd, per rotation, of the fixing roller 100 in terms of the circumferential direction.

Referring to FIG. 9, the difference δTav (=Tcp−Tavd) between the average temperature Tavd per rotation and the target temperature Tcp for image formation, and the post-correction signal Tb (=Td+δTav) is stored in Address 70H of the RAM 304, as a corrected temperature signal. Then, the CPU 301 reads the value of the post-correction temperature signal Tb in Address 70H, and adds 100H to the read value. Then, it reads the contents of the LUT in the RAM 304, the value of the address of which is the sum of the value in Address 70H, and 100H. Then, it sets the value read in the LUT, in the D/A converter 303. Then, it controls the amount of the electric power supplied to the inductive heating coil L1 using the output of the D/A converter 303 as a feedback signal FB.

When the average temperature Tavd of the fixing roller 100 is equal to the target temperature Tcp for image formation, δTav=Tcp−Tavd=0; and the post-correction temperature signal Tb=Td+δTav=Td. When the temperature Td of the fixing roller 100 detected by the temperature detection element TH1 during an image forming operation is equal to the target temperature Tcp for image formation (Td=Tcp), the feedback signal FB (=Wcp) is outputted, and the electric power W (=Wcp) is applied to the inductive heating coil L1. When Td (temperature of fixing roller 100)=Tb≦T1, a feedback signal having a value of W1 is outputted, and the maximum electric power W1 is applied to the inductive heating coil L1. When T1 (temperature of fixing roller 100)<Tb=Td<T2, a feedback signal FB, the value of which monotonically decreases within a range, in which an inequity: W1<W<W2 is satisfied, as the temperature of the fixing roller 100 increases, is outputted, so that the amount of the electric power applied to the inductive heating coil L1 is monotonically reduced as the temperature of the fixing roller 100 increases. When T2 (temperature of fixing roller 100) ≦Tb=Td, a feedback signal FB (=W2) is outputted, so that the amount of the electric power applied to the inductive heating coil L1 becomes minimum (=W2).

When Tavd (average temperature)<Tcp (target temperature for image formation), δTav=Tavd−Tcp<0, and Tb (corrected temperature signal)=Td+δTav<Td. Therefore, electric power is applied to the inductive heating coil L1 by an amount greater than the amount by which electric power is applied to inductive heating coil L1 when Td (temperature Td of the fixing roller 100 detected by temperature detection element TH1 during an image forming operation)=Tcp.

When Tavd (average temperature)>Tcp (target temperature for image formation), δTav=Tavd−Tcp>0, and Tb (post-correction temperature signal)=Td+δTav>Td. Therefore, electric power is applied to the inductive heating coil L1 by an amount smaller than the amount by which electric power is applied to inductive heating coil L1 when Td (temperature Td of the fixing roller 100 detected by temperature detection element TH1 during an image forming operation)=Tcp.

In this embodiment, in order to prevent the temperature increase at the lengthwise end portions of the fixing roller 100, the CPU 301 moves the magnetic field blocking member 150 from the position shown in FIG. 7(*a*) to the position shown in FIG. 7(*b*), with the use of a motor (unshown) for moving the magnetic field blocking member 150, in accordance with the paper size data.

In order to control the electric power applied to the inductive heating coil L1, the sum of Tav and α (correction factor) is added to the target temperature Tcp for image formation, and the thus obtained sum is used as a new temperature correction signal Tb2 (=Td+α+δTav). Then, a feedback signal FB in proportion to the new temperature signal Tb2 (=Td+α+δTav) is outputted to adjust the amount of the electric power applied to the inductive heating coil L1. When α (correction factor)>1, the correction factor α is effective to prevent the problem that the temperature of the center portion of the fixing roller 100 in terms of the lengthwise direction falls as the heat generated across the center portion of the fixing roller 100 is robbed by the lengthwise end portions of the fixing roller 100 and the components in the adjacencies of the fixing roller 100. When an image is formed on the standard size paper, the dimension of which in terms of the lengthwise direction of the fixing roller 100 is virtually the same as that of the fixing roller 100, the correction factor α is to be set to one (α=1).

Further, rewriting the contents of the LUT so that the amount of the electrical power applied to the inductive beating coil L1 can be adjusted in accordance with recording medium size, in particular, a smaller size, is also effective. For example, when the solid line (a) in FIG. 9 represents the output of the feedback signal FB during the normal image forming operation, the LUT may be rewritten to represent the solid line (c) or (d), which is created by shifting the solid line (a) by a distance equivalent to the correction factor α. The data in the LUT can be optionally changed, affording more latitude in the temperature adjustment.

Further, it is easy to change the correction gain of δTav by using δTav×β. In such a case, the inclination of the solid line (a) in FIG. 9 is changed.

When the image formation stage, warmup stage, and standby stage are equal in the target temperature, and the fixing roller 100 is kept stationary at the warmup and standby stages, the same LUT can be used for the image formation stage and standby stage. The fixing roller 100 is kept stationary at the warmup stage immediately after an image forming apparatus is turned on, and the standby stage after the achievement of the predetermined target temperature. Therefore, the post-correction temperature signal Tb is set to Td (Tb=Td) without carrying out the process which involves averaging, and the contents of the LUT corresponding to the temperature Td (=Tb) of the fixing roller 100 are set for the D/A converter 303.

When the target temperature Tst for the warmup stage and standby stage is lower than the target temperature Tcp for the image formation stage, it is also effective to rewrite the LUT so that its contents are represented by the solid line (b) in FIG. 9. In such a case, the average temperature of the fixing roller is not obtained, and the correction factor α is set to zero (α=0), or the correction factor β is set to one (β=1). The post-correction signal Tb is set to Td (Tb=Td). Thus, the target temperature is the target temperature Tst for the standby period, and the amount of the electric power applied to the inductive heating coil L1 is the predetermined amount Wst. Here, Wst<Wcp, and the amount of the electric power applied to the inductive heating coil L1 is controlled so that the fixing roller temperature becomes the target temperature Tst for the standby period, which is lower than the target temperature Tcp for the image formation period. Referring to the solid line (b) in FIG. 9, when the temperature of the fixing roller 100 is higher than the target temperature Tst for the standby period, the amount of the electric power applied to the inductive heating coil L1 is smaller than the predetermined amount Wst, whereas when the temperature of the fixing roller 100 is lower than the target temperature Tst for the standby period, the amount of the electric power applied to the inductive heating coil L1 is greater than the predetermined amount Wst.

Here, for the purpose of reducing the nonuniformity in the temperature of the fixing roller in terms of the circumferential direction, it is feasible to keep the fixing roller rotating during the warmup period and standby period. Keeping the fixing roller rotating during the warmup period and standby period makes it possible to evenly heat the fixing roller in terms of the circumferential direction, reducing thereby the unevenness in the temperature of the fixing roller in terms of the circumferential direction.

However, if the fixing roller is kept rotating during the warmup period and standby period, it is possible that such problems that the fixing roller is damaged by friction, that service lives of the motor and driving force transmission mechanism are reduced, and that the noise level is higher, will occur. Thus, the fixing roller may be intermittently rotated in such a manner that it is briefly rotated and then kept stationary for a while. In other words, the target temperature is set to the target temperature Tst for the standby period, and the temperature control which involves the average fixing roller temperature is executed based on the LUT represented by the solid line (b) in FIG. 9. This method for controlling the fixing roller temperature, in which the fixing roller is rotated even during the warmup period and standby period, and the average temperature of the fixing roller is also taken into consideration, makes it possible to better control the fixing roller temperature.

While the invention has been described with reference to the structures disclosed herein, it is not confined to the details set forth, and this application is intended to cover such modifications or changes as may come within the purposes of the improvements or the scope of the following claims.

What is claimed is:

1. A heating apparatus, comprising:

magnetic field generating means for generating an alternating magnetic field;

a rotatable member disposed in the alternating magnetic field and capable of generating heat at a part with respect to a circumferential direction by electromagnetic induction;

temperature detecting means for detecting a temperature of said rotatable member;

comparison means for comparing an output of said temperature detecting means with a target temperature; and control means for controlling electric energy supply to said magnetic field generating means on the basis of a comparison result of said comparison means, wherein in at least one period during a stand-by state, said control means controls the electric energy supply to said magnetic field generating means while said rotatable member does not rotate, and in an image forming operation, said control means controls the electric energy supply to said magnetic field generating means on the basis of comparison between the target temperature and an average value of temperatures detected at circumferentially different positions of said rotatable member while said rotatable member is rotating.

2. An apparatus according to claim 1, wherein said control means variably controls the electric energy supply with a degree of difference.

3. An apparatus according to claim 1, wherein the temperatures detected by said temperature detecting means cover one full-turn of said rotatable member.

4. An apparatus according to claim 1, further comprising a memory for storing the detected temperatures.

5. An apparatus according to claim 1, wherein the different positions include a position where the heat is generated by the electromagnetic induction and a position where the heat is substantially not generated by the electromagnetic induction in the stand-by state.

6. An apparatus according to claim 1, further comprising a pressing member that cooperates with said rotatable member to form a nip therebetween, wherein an unfixed image carried on a recording material is fixed while the recording material carrying the unfixed image is passed through the nip.

* * * * *